United States Patent [19]

Yodogawa

[11] 4,320,379

[45] Mar. 16, 1982

[54] VOLTAGE NON-LINEAR RESISTOR

[75] Inventor: Masatada Yodogawa, Tokyo, Japan

[73] Assignee: TDK Electronics Co., Ltd., Tokyo, Japan

[21] Appl. No.: 184,953

[22] Filed: Sep. 8, 1980

[30] Foreign Application Priority Data

| | | | |
|---|---|---|---|
| Sep. 7, 1979 | [JP] | Japan | 54-114860 |
| Apr. 2, 1980 | [JP] | Japan | 55-43190 |
| Apr. 4, 1980 | [JP] | Japan | 55-44274 |
| Apr. 17, 1980 | [JP] | Japan | 55-50777 |
| Aug. 2, 1980 | [JP] | Japan | 55-106682 |
| Aug. 2, 1980 | [JP] | Japan | 55-106683 |
| Aug. 2, 1980 | [JP] | Japan | 55-106684 |

[51] Int. Cl.[3] ..... H01C 7/10

[52] U.S. Cl. ..... 338/21; 252/520; 252/521

[58] Field of Search ..... 338/20, 21; 252/518, 252/520, 521; 106/39.5, 73.2; 361/127

[56] References Cited

U.S. PATENT DOCUMENTS

| | | | |
|---|---|---|---|
| 4,033,906 | 7/1977 | Nagasawa et al. | 252/521 X |
| 4,069,061 | 1/1978 | Nagasawa et al. | 106/73.2 |
| 4,077,915 | 3/1978 | Yodogawa et al. | 338/21 X |
| 4,160,748 | 7/1979 | Yodogawa et al. | 252/518 |

FOREIGN PATENT DOCUMENTS

| | | | |
|---|---|---|---|
| 2641996 | 4/1977 | Fed. Rep. of Germany | 338/21 |
| 2800495 | 7/1978 | Fed. Rep. of Germany | 338/21 |
| 55-18012 | 2/1980 | Japan | 338/21 |

*Primary Examiner*—C. L. Albritton

*Attorney, Agent, or Firm*—Oblon, Fisher, Spivak, McClelland & Maier

[57] ABSTRACT

A voltage non-linear resistor comprises a sintered body of a ceramic composition comprising zinc oxide at a ratio of 99.88 to 84.88 mol % as ZnO; a praseodymium oxide component at a ratio of 0.01 to 0.035 mol % as $Pr_2O_3$ and a lanthanum oxide component at a ratio of 0.01 to 0.035 mol % as $La_2O_3$ and a cobalt oxide component at a ratio of 0.1 to 15 mol % as CoO and a specific additional component selected from chromium oxide, boron oxide, silicon oxide, titanium oxide, tin oxide, zirconium oxide, niobium oxide, tantalum oxide, tungsten oxide and germanium oxide at a ratio of 0.0001 to 0.05 mol %.

10 Claims, 1 Drawing Figure

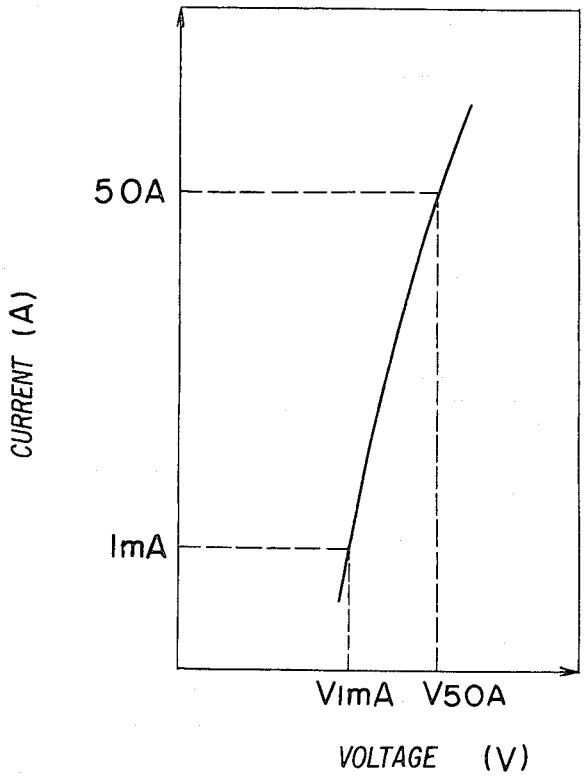
50A
1mA
CURRENT (A)
V1mA
V50A
VOLTAGE (V)

VOLTAGE NON-LINEAR RESISTOR

BACKGROUND OF THE INVENTION

1. Field of the Invention

The present invention relates to an improved ceramic composition for voltage non-linear resistor which comprises zinc oxide as a main component and components of praseodymium, lanthanum and cobalt and an additional component as minor components. More particularly, it relates to a sintered body of a ceramic composition for voltage non-linear resistor which has remarkably large voltage non-linearity and large discharge capacity.

2. Description of the Prior Art

Recently, ceramic non-linear resistors (hereinafter referring to as ceramic varistors) having excellent voltage non-linearity characteristics comprising zinc oxide as a main component have been widely used as electronic parts for protection of a circuit and prevention of erroneous operation. Varistors having excellent voltage non-linearity in a large current region have been also required. In voltage-ampere characteristic of a varistor, a current to a voltage is non-linearity varied as shown in the FIGURE. Thus, the voltage-ampere characteristic of a varistor is usually shown by the equation:

$$I=(V/C)^{\alpha}$$

wherein I designates current passed through the varistor; V designates a voltage applied to the varistor; C designates a constant corresponding to the resistance; and $\alpha$ designates an index for a non-linearity. A voltage for passing a current of 1 mA is usually referred to as a varistor voltage.

In a broad current region, $\alpha$ is varied depending upon the voltage. When the non-linearity in a wide current region, it is preferable to consider a ratio of a voltage in the low current region to a voltage in the large current region, for example, a ratio of $V_{1mA}$ to $V_{50A}$ shown in the FIGURE. The voltage non-linearity characteristic is superior depending upon lower voltage ratio.

Recently, ceramic varistors as a combination of an electrode and a ceramic comprising zinc oxide as a main component and oxides of bithmuth, antimony, manganese, cobalt and chromium as minor components have been developed. The voltage non-linearity of such ceramic varistor is resulted by the characteristics of the sintered composition. The non-linearity is advantageously remarkable in the wide current range. Thus, on the other hand, the composition comprises components which are easily volatilized at high temperature required for sintering a composition for the varistor, such as bismuth and antimony. It is necessary to consider special conditions for sintering compositions in a mass production so as to produce varistors having the same characteristic at a low ratio of defective products whereby the production cost hs been remarkably high.

On the other hand, ceramic varistors as a combination of an electrode and a ceramic comprising zinc oxide as a main component and components of oxides of praseodymium, cobalt, chromium and potassium have been also developed (Japanese Unexamined Patent Publication No. 114093/1978). These ceramic varistors do not contain volatile components such as bithmuth and antimony components, and have excellent voltage non-linearity, however, it is necessary to incorporate, potassium and chromium components so as to improve voltage non-linearity characteristics in the large current region. Thus, the incorporation of potassium causes the serious problem of low moisture resistance as electronic parts. In the practical application of such ceramic varistor, it is necessary to protect such ceramic varistor by coating the surface of the sintered ceramic varistor with a molten glass whereby steps for the production are disadvantageously increased and a cost for production is disadvantageously high. Moreover, a relatively large quantity of praseodymium having high purity is needed, though the source of praseodymium is not large enough. This is disadvantageously uneconomical.

SUMMARY OF THE INVENTION

It is an object of the present invention to overcome the disadvantages of the conventional ceramic varistors comprising zinc oxide as a main component.

It is another object of the present invention to provide ceramic composition for voltage non-linear resistor as a ceramic varistor which has excellent voltage-ampere characteristics from a small current region to a large current region with excellent moisture resistance and which can be economically produced.

The foregoing and other objects of the present invention have been attained by providing a voltage non-linear resistor which comprises a sintered body of a ceramic composition comprising a zinc oxide component at a ratio of 99.88 to 84.88 mol % as ZnO; a praseodymium oxide component and a lanthanum oxide component, each at a ratio of 0.01 to 0.035 mol % as $R_2O_3$ (R is Pr or La); a cobalt oxide component at a ratio of 0.1 to 15 mol % as CoO and a specific additional component selected from components of chromium oxide, boron oxide, silicon oxide, titanium oxide, tin oxide, zirconium oxide, niobium oxide, tantalum oxide and tungsten oxide and germanium oxide at a ratio of 0.0001 to 0.05 mol %.

BRIEF DESCRIPTION OF THE DRAWING

The FIGURE shows voltage-ampere characteristics of a ceramic varistor.

DETAILED DESCRIPTION OF THE PREFERRED EMBODIMENTS

The inventors have studied and found the fact that the ceramic varistor comprising zinc oxide as a main component and components of praseodymium, lanthanum and cobalt can be improved to overcome the disadvantages, without an incorporation of an alkali metal component so as to obtain a ceramic varistor having excellent voltage non-linearity in a large current region.

It has not been clearly understood why the incorporation of such additional component results in the improvement of the ceramic varistor.

The fine structure of ceramic varistor comprising zinc oxide as a main component is considered that zinc oxide crystals having relatively low specific resistance are surrounded by an intergranular layer having relatively high specific resistance. Lower specific resistance in the zinc oxide crystals and higher specific resistance in the intergranular layer are advantageous for the non-linearity characteristics. A small amount of the specific additional component is solid soluble in the zinc oxide crystal to decrease the specific resistance of the crystals whereby the voltage non-linearity characteristic is improved. Thus, if the content of the specific additional component is increased too much, the specific resistivity of the intergranular layer for contributing to the non-linearity which surrounds the crystals is also decreased by the specific additional component whereby the non-linearity is decreased. If the distribution of the specific additional component is not uniform in the ceramic varistor, the distribution of resistances and distribution of non-linearities in one ceramic varistor are not uniform. When the electric field is applied to the ceramic varistor, a current is partially concentrated to rise the temperature at the portions whereby it is broken at the portions.

It is important to give the uniform distribution of the specific additive component in a form of solid solution in the zinc oxide crystals and to decrease nonuniform distribution of the specific additional component near the intergranular layer, whereby the voltage non-linearity characteristic can be improved.

When the chromium component is incorporated, it is possible to incorporate a chromium compound in a form of a solution or a remarkably fine powder having a particle size of less than 0.2μ. A chromium oxide powder having rough particles such as 0.5 microns is used, it is necessary to incorporate the chromium component at a ratio of more than 0.05 atom % so as to impart the effect of the chromium component, because of distribution of the chromium component. Therefore, the non-linearity characteristic in the low current region is remarkably inferior. Moreover, the growth of zinc oxide crystals in the crystallization is adversely affected by the chromium component to result in smaller and nonuniform crystal grains, and the reliability of the ceramic varistor is low. If a potassium component is incorporated to overcome such disadvantages, the moisture resistance is lowered by the addition of the potassium component. In the present invention, the dispersibility of the chromium component is improved to decrease the content of the chromium component whereby a sintered body made of uniform grains of the zinc oxide crystals is obtained to be remarkably reliable. It is preferable to incorporate only small contents of the praseodymium component and the lanthanum component in the incorporation of only small content of the chromium component. The precious sources can be saved to be economical.

The specific additional component of the chromium component has been discussed. Thus, the same consideration is applied for the incorporation of the other specific additional component. That is, the boron component, the silica component, the titanium component, the tin component, zirconium component, niobium component, the tantalum component the tungsten component or the germanium component can be incorporated to impart the same advantageous effect.

In accordance with the incorporation of the small amount of the specific additional component, a ceramic varistor having excellent voltage non-linearity characteristic as well as excellent current surge can be obtained.

The composition for voltage non-linear resistor of the present invention comprises the zinc oxide component at a ratio of 99.88 to 84.88 mol % as ZnO; the praseodymium oxide component at a ratio of 0.01 to 0.035 mol % as $Pr_2O_3$; the lanthanum oxide component at a ratio of 0.01 to 0.035 mol % as $La_2O_3$, the cobalt oxide component at a ratio of 0.1 to 15 mol % as CoO and the specific additional component; at a ratio of 0.0001 to 0.05 mol %.

The specific additive component can be a compound which is convertible into the corresponding oxide by a sintering at 1250° C. to 1550° C., preferably 1250° C. to 1500° C.

The specific additive component is preferably a water soluble salt which is convertible into the corresponding oxide by the sintering though it can be fine powder.

The present invention will be further illustrated by certain examples and references which are provided for purposes of illustration only and are not intended to be limiting the present invention.

EXAMPLES AND REFERENCES

Zinc oxide, praseodymium oxide, lanthanum oxide and cobalt oxide and each specific additional component were weighed at ratios shown in Table 1 and mixed in a wet ball-mill. The mixture was dried and admixed with an aqueous solution of polyvinyl alcohol as a binder and the mixture was granulated and press-molded to form each disc having a diameter of 15 mm and a thickness of 1.5 mm by a press-molding method. The molded product was sintered at 1250° to 1450° C. for 2 hours to obtain a specimen. A silver electrode having a diameter of 11.5 mm was connected to both sides of the specimen, by a paste-baking method and each voltage-ampere characteristic was measured. The results are shown in Tables.

Note: *designate references

TABLE 1

| | Composition (mol %) | | | | Sintering temp. of 1250–1450° C. Voltage-ampere characteristics | | |
|---|---|---|---|---|---|---|---|
| No. | $Pr_2O_3$ | $La_2O_3$ | CoO | $Cr_2O_3$ | $V_{1mA}$(V) | α | $V_{50A}/V_{1mA}$ |
| 1 | 0.025 | 0.025 | 0.1 | 0.0001 | 40 | 18 | 2.00 |
| 2 | 0.025 | 0.025 | 1 | 0.002 | 60 | 31 | 1.61 |
| 3 | 0.025 | 0.025 | 3 | 0.006 | 75 | 30 | 1.65 |
| 4 | 0.025 | 0.025 | 10 | 0.02 | 86 | 21 | 1.98 |
| 5 | 0.01 | 0.01 | 1 | 0.002 | 35 | 19 | 2.00 |
| 6 | 0.035 | 0.035 | 1 | 0.002 | 65 | 20 | 1.95 |
| 7* | 0.025 | 0.025 | 1 | 0 | 185 | 8 | 3.17 |
| 8* | 0.025 | 0.025 | 3 | 0 | 320 | 7 | 3.52 |
| 9* | 0.025 | 0.025 | 1 | 0.002 | 98 | 11 | 2.35 |
| 10* | 0.025 | 0.025 | 3 | 0.006 | 120 | 13 | 2.51 |

TABLE TABLE 2

| | Composition (mol %) | | | | Sintering temp. of 1250–1500° C. Voltage-ampere characteristics | | |
|---|---|---|---|---|---|---|---|
| No. | $Pr_2O_3$ | $La_2O_3$ | CoO | $Cr_2O_3$ | $V_{1mA}$(V) | α | $V_{50a}/V_{1mA}$ |
| 1 | 0.03 | 0.03 | 1 | 0.02 | 45 | 28 | 1.65 |
| 2 | 0.03 | 0.03 | 2 | 0.025 | 54 | 33 | 1.62 |
| 0.03 | 0.03 | 0.03 | 5 | 0.03 | 62 | 32 | 1.67 |
| 4 | 0.03 | 0.03 | 10 | 0.04 | 83 | 29 | 1.70 |
| 5 | 0.03 | 0.03 | 15 | 0.05 | 105 | 17 | 2.00 |
| 6* | 0.03 | 0.03 | 1 | 0 | 178 | 7 | — |
| 7* | 0.03 | 0.03 | 5 | 0 | 451 | 5 | — |
| 8* | 0.03 | 0.03 | 1 | 0.02 | 88 | 9 | — |
| 9* | 0.03 | 0.03 | 5 | 0.03 | 250 | 8 | — |

TABLE 3

| | Composition (mol %) | | | | Sintering temp. of 1250–1500° C. Voltage-ampere characteristics | | |
|---|---|---|---|---|---|---|---|
| No. | $Pr_2O_3$ | $La_2O_3$ | CoO | $B_2O_3$ | $V_{1mA}$(V) | α | $V_{50a}/V_{1mA}$ |
| 1 | 0.025 | 0.025 | 0.1 | 0.0001 | 42 | 15 | 2.00 |
| 2 | 0.025 | 0.025 | 1 | 0.010 | 45 | 28 | 1.60 |

TABLE 3-continued

| No. | Composition (mol %) $Pr_2O_3$ | $La_2O_3$ | CoO | $B_2O_3$ | Sintering temp. of 1250–1500° C. Voltage-ampere characteristics $V_{1mA}$(V) | α | $V_{50a}/V_{1mA}$ |
|---|---|---|---|---|---|---|---|
| 3 | 0.025 | 0.025 | 3 | 0.015 | 50 | 30 | 1.65 |
| 4 | 0.025 | 0.025 | 10 | 0.04 | 87 | 20 | 1.97 |
| 5 | 0.025 | 0.025 | 15 | 0.05 | 95 | 16 | 2.00 |
| 6 | 0.01 | 0.01 | 1 | 0.01 | 35 | 15 | 1.98 |
| 7 | 0.035 | 0.035 | 1 | 0.01 | 72 | 17 | 1.95 |
| 8* | 0.025 | 0.025 | 1 | 0 | 185 | 8 | 3.17 |
| 9* | 0.025 | 0.025 | 3 | 0 | 320 | 7 | 3.52 |

TABLE 4

| No. | Composition (mol %) $Pr_2O_3$ | $La_2O_3$ | CoO | $SiO_2$ | Sintering temp. of 1250–1500° C. Voltage-ampere Characteristics $V_{1mA}$(V) | α | $V_{50A}/V_{1mA}$ |
|---|---|---|---|---|---|---|---|
| 1 | 0.025 | 0.025 | 0.1 | 0.001 | 38 | 16 | 2.00 |
| 2 | 0.025 | 0.025 | 1 | 0.010 | 47 | 30 | 1.60 |
| 3 | 0.025 | 0.025 | 3 | 0.015 | 52 | 31 | 1.63 |
| 4 | 0.025 | 0.025 | 10 | 0.04 | 86 | 22 | 1.98 |
| 5 | 0.025 | 0.025 | 15 | 0.05 | 101 | 17 | 2.00 |
| 6 | 0.01 | 0.01 | 1 | 0.01 | 40 | 16 | 1.98 |
| 7 | 0.035 | 0.035 | 1 | 0.01 | 68 | 17 | 1.96 |
| 8* | 0.025 | 0.025 | 1 | 0 | 185 | 8 | 3.17 |
| 9* | 0.025 | 0.025 | 3 | 0 | 320 | 7 | 3.52 |

TABLE 5

| No. | Composition (mol %) $Pr_2O_3$ | $La_2O_3$ | CoO | M | $MO_2$ | Sintering temp. of 1300–1550° C. Voltage-ampere characteristic $V_{1mA}$(V) | α | $V_{50A}/V_{1mA}$ |
|---|---|---|---|---|---|---|---|---|
| 1 | 0.025 | 0.025 | 0.1 | Ti | 0.001 | 40 | 16 | 2.01 |
| 2 | 0.025 | 0.025 | 1 | Ti | 0.010 | 49 | 31 | 1.59 |
| 3 | 0.025 | 0.025 | 3 | Ti | 0.015 | 55 | 30 | 1.61 |
| 4 | 0.025 | 0.025 | 10 | Ti | 0.04 | 88 | 21 | 1.95 |
| 5 | 0.025 | 0.025 | 15 | Ti | 0.05 | 105 | 17 | 2.00 |
| 6 | 0.01 | 0.01 | 1 | Ti | 0.01 | 43 | 17 | 1.97 |
| 7 | 0.035 | 0.035 | 1 | Ti | 0.01 | 71 | 16 | 1.98 |
| 8 | 0.025 | 0.025 | 0.1 | Ge | 0.001 | 44 | 17 | 2.00 |
| 9 | 0.025 | 0.025 | 1 | Ge | 0.010 | 52 | 32 | 1.58 |
| 10 | 0.025 | 0.025 | 3 | Ge | 0.015 | 57 | 31 | 1.59 |
| 11 | 0.025 | 0.025 | 10 | Ge | 0.04 | 91 | 20 | 1.96 |
| 12 | 0.025 | 0.025 | 15 | Ge | 0.05 | 107 | 16 | 2.01 |
| 13 | 0.025 | 0.025 | 0.1 | Sn | 0.001 | 50 | 17 | 1.99 |
| 14 | 0.025 | 0.025 | 1 | Sn | 0.010 | 55 | 33 | 1.57 |
| 15 | 0.025 | 0.025 | 3 | Sn | 0.015 | 61 | 32 | 1.59 |
| 16 | 0.025 | 0.025 | 10 | Sn | 0.04 | 95 | 22 | 1.95 |
| 17 | 0.025 | 0.025 | 15 | Sn | 0.05 | 112 | 15 | 2.00 |
| 18 | 0.025 | 0.025 | 0.1 | Zr | 0.001 | 52 | 16 | 2.02 |
| 19 | 0.025 | 0.025 | 1 | Zr | 0.010 | 56 | 32 | 1.60 |
| 20 | 0.025 | 0.025 | 3 | Zr | 0.015 | 65 | 30 | 1.61 |
| 21 | 0.025 | 0.025 | 10 | Zr | 0.04 | 100 | 20 | 1.96 |
| 22 | 0.025 | 0.025 | 15 | Zr | 0.05 | 115 | 15 | 2.02 |
| 23 | 0.025 | 0.025 | 1 | Ti<br>Ge | 0.005<br>0.005 | 50 | 30 | 1.59 |
| 24 | 0.025 | 0.025 | 1 | Sn<br>Zr | 0.005<br>0.005 | 55 | 31 | 1.57 |
| 25* | 0.025 | 0.025 | 1 | — | | 185 | 8 | 3.17 |
| 26* | 0.025 | 0.025 | 3 | — | | 320 | 7 | 3.52 |

TABLE 6

| No. | Composition (mol %) $Pr_2O_3$ | $La_2O_3$ | CoO | M | $MO_2H_5$ | Sintering temp. of 1300–1500° C. Voltage-ampere characteristic $V_{1mA}$(V) | β | $V_{50A}/V_{1mA}$ |
|---|---|---|---|---|---|---|---|---|
| 1 | 0.025 | 0.025 | 0.1 | Nb | 0.001 | 37 | 16 | 2.00 |
| 2 | 0.025 | 0.025 | | Nb | 0.010 | 45 | 31 | 1.59 |
| 3 | 0.025 | 0.025 | 3 | Nb | 0.015 | 51 | 30 | 1.60 |
| 4 | 0.025 | 0.025 | 10 | Nb | 0.04 | 81 | 21 | 1.94 |
| 5 | 0.025 | 0.025 | 15 | Nb | 0.05 | 97 | 17 | 2.00 |
| 6 | 0.01 | 0.01 | 1 | Nb | 0.01 | 41 | 16 | 1.99 |
| 7 | 0.035 | 0.035 | 1 | Nb | 0.01 | 67 | 16 | 1.99 |
| 8 | 0.025 | 0.025 | 0.1 | Ta | 0.001 | 42 | 17 | 1.99 |
| 9 | 0.025 | 0.025 | 1 | Ta | 0.010 | 49 | 32 | 1.59 |
| 10 | 0.025 | 0.025 | 3 | Ta | 0.015 | 55 | 31 | 1.61 |
| 11 | 0.025 | 0.025 | 10 | Ta | 0.04 | 84 | 23 | 1.96 |
| 12 | 0.025 | 0.025 | 15 | Ta | 0.05 | 101 | 17 | 2.00 |
| 13 | 0.01 | 0.01 | 1 | Ta | 0.01 | 45 | 16 | 2.00 |
| 14 | 0.035 | 0.035 | 3 | Ta | 0.01 | 72 | 15 | 1.99 |
| 15 | 0.025 | 0.025 | 1 | Nb | 0.005 | 47 | 32 | 1.58 |

TABLE 6-continued

| No. | Composition (mol %) $Pr_2O_3$ | $La_2O_3$ | CoO | M | $MO_2H_5$ | Sintering temp. of 1300–1500° C. Voltage-ampere characteristic $V_{1mA}$(V) | $\beta$ | $V_{50A}/V_{1mA}$ |
|---|---|---|---|---|---|---|---|---|
| 16 | 0.025 | 0.025 | 3 | Ta<br>Nb<br>Ta | 0.005<br>0.010<br>0.005 | 53 | 30 | 1.59 |
| 17* | 0.025 | 0.025 | 1 | — | | 185 | 8 | 3.17 |
| 18* | 0.025 | 0.025 | 3 | — | | 320 | 7 | 3.52 |

TABLE 7

| No. | Composition (mol %) $Pr_2O_3$ | $La_2O_3$ | CoO | $WO_3$ | Sintering temp. of 1300–1550° C. Voltage-ampere Characteristics $V_{1mA}$(V) | $\alpha$ | $V_{50A}/V_{1mA}$ |
|---|---|---|---|---|---|---|---|
| 1 | 0.025 | 0.025 | 0.1 | 0.001 | 35 | 15 | 2.00 |
| 2 | 0.025 | 0.025 | 1 | 0.010 | 42 | 30 | 1.58 |
| 3 | 0.025 | 0.025 | 3 | 0.015 | 49 | 29 | 1.60 |
| 4 | 0.025 | 0.025 | 10 | 0.004 | 78 | 20 | 1.93 |
| 5 | 0.025 | 0.025 | 15 | 0.05 | 95 | 16 | 1.99 |
| 6 | 0.01 | 0.01 | 1 | 0.01 | 38 | 16 | 1.98 |
| 7 | 0.035 | 0.035 | 1 | 0.01 | 65 | 15 | 1.98 |
| 8* | 0.025 | 0.025 | 1 | 0 | 185 | 8 | 3.17 |
| 9* | 0.025 | 0.025 | 3 | 0 | 320 | 7 | 3.52 |

When any specific additional component was not incorporated or the specific additional component having a particle size of 0.5$\mu$ was incorporated, the voltage-ampere characteristics are remarkably inferior.

In accordance with the present invention incorporating the specific additional component in uniform distribution, the values are remarkably high and the ratios of $V_{50A}/V_{1mA}$ are remarkably low. The results shows excellent voltage non-linearity characteristics from the small current region to large current region. This is remarkably effective in the practical use. The excellent voltage non-linearity characteristics are resulted by the characteristics of the bulk of the sintered body. The ceramic varistor having a desired voltage-ampere characteristic can be easily obtained by selecting a thickness of the specimen and a condition for sintering.

The reasons for the definitions of the contents of the components are as follows.

When a content of the praseodymium oxide component and a content of the lanthanum oxide component are respectively lower than 0.01 mol %, the effect is not high enough. On the contrary, when it is more than 0.035 mol %, the resistance is lower and the voltage non-linearity in the small current region is inferior.

When a content of the cobalt oxide component is less than 0.1 mol %, the effect is not high enough. On the contrary, when it is more than 15 mol %, the voltage non-linearity in the large current region is inferior.

When a content of the specific additive component is less than 0.0001 mol %, the effect is not high enough. On the contrary, when it is more than 0.05 mol %, the voltage non-linearity in the small current region is remarkably inferior.

In the examples, the water soluble chromium chloride was used as the chromium source and was mixed with the other components as a solution of the chromium compound by the wet process. The other water soluble chromium compounds such as chromium nitrate can be also used to give the same characteristics. The chromium compound is not limited to be a water soluble compound but can be the chromium compound in a form of fine particle such as colloidal chromium hydroxide. This consideration can be applied for the other specific additional component, silica gel, silica sol, colloidal titanium hydroxide, tin hydroxide, zirconium hydroxide, tungsten hydroxide, germanium hydroxide and water soluble titanium salt, tin salt, zirconium salt, tungsten salt and germanium salt can be also used. The typical compounds include carbonates, nitrates, hydroxides, chlorides and alcoholates thereof which are convertible into the corresponding oxides by the sintering.

In the examples, the praseodymium oxide, the lanthanum oxide and the cobalt oxide were used, however, the corresponding compounds such as carbonates, nitrates, hydroxides and chlorides which are convertible into the corresponding oxides by the sintering can be also used to impart the same effect.

The preparation of the ceramic varistors of the present invention can be the conventional processes for ceramics. The condition for calcination can be selected as desired. When the calcined mixture is finely pulverized, there is not any trouble. The sintering process can be carried out in air or oxygen atmosphere and can be controlled to give a desired partial pressure of oxygen with an inert gas such as nitrogen and argon so as to impart the optimum characteristics.

The electrodes can be brought into an ohmic contact or a non-ohmic contact and can be bonded by the conventional baking process, plating process, metal vapor deposition process or sputtering process. The conditions for the preparations are described in U.S. Pat. No. 4,160,748 and U.S. Pat. No. 4,077,915.

I claim

1. A voltage non-linear resistor which comprises a sintered body of a ceramic composition comprising zinc oxide at a ratio of 99.88 to 84.88 mol % as ZnO; a praseodymium oxide component at a ratio of 0.01 to 0.035 mol % as $Pr_2O_3$ and a lanthanum oxide component at a ratio of 0.01 to 0.035 mol % as $La_2O_3$ and a cobalt oxide component at a ratio of 0.1 to 15 mol % as CoO and a specific additional component selected from chromium oxide, boron oxide, silicon oxide, titanium oxide, tin oxide, zirconium oxide, niobium oxide, tantalum oxide, tungsten oxide and germanium oxide at a ratio of 0.0001 to 0.05 mol %.

2. The voltage non-linear resistor according to claim 1 wherein said specific additional component is the oxide component formed from a colloidal metal hydroxide or a water soluble metal salt which is convertible into the metal oxide by a sintering.

3. The voltage non-linear resistor according to claim 1 wherein the chromium oxide component is incorporated at a ratio of 0.0001 to 0.02 mol % as $Cr_2O_3$.

4. The voltage non-linear resistor according to claim 1 wherein the chromium oxide component is incorporated at a ratio of 0.02 to 0.05 mol %.

5. The voltage non-linear resistor according to claim 1 wherein the boron oxide component is incorporated at a ratio of 0.0001 to 0.05 mol % as $B_2O_3$.

6. The voltage non-linear resistor according to claim 1 wherein the silicon oxide component is incorporated at a ratio of 0.0001 to 0.05 mol % as $SiO_2$.

7. The voltage non-linear resistor according to claim 1 wherein the titanium oxide, tin oxide, zirconium oxide, or germanium oxide component is incorporated at a ratio of 0.0001 to 0.05 mol % as $MO_2$ (M is Ti, Sn, Zr or Ge).

8. The voltage non-linear resistor according to claim 1 wherein the niobium oxide or tantalum oxide component is incorporated at a ratio of 0.0001 to 0.05 mol % as $M_2O_5$ (M is Nb or Ta).

9. The voltage non-linear resistor according to claim 1 wherein the tungsten oxide component is incorporated at a ratio of 0.0001 to 0.05 mol % as $WO_3$.

10. The voltage non-linear resistor according to claim 1 which comprises said sintered body obtained by sintering at a temperature from 1250° C. to 1550° C.

* * * * *